US009096942B2

(12) United States Patent
Joung et al.

(10) Patent No.: US 9,096,942 B2
(45) Date of Patent: Aug. 4, 2015

(54) ELECTROPHORETIC-DEPOSITED SURFACES

(75) Inventors: Young Soo Joung, Cambridge, MA (US); Cullen Richard Buie, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 42 days.

(21) Appl. No.: 13/402,126

(22) Filed: Feb. 22, 2012

(65) Prior Publication Data

US 2012/0211365 A1 Aug. 23, 2012

Related U.S. Application Data

(60) Provisional application No. 61/445,432, filed on Feb. 22, 2011.

(51) Int. Cl.

| | |
|---|---|
| ***C25D 13/18*** | (2006.01) |
| ***C25D 13/02*** | (2006.01) |
| ***C25D 13/12*** | (2006.01) |

(52) U.S. Cl.

CPC ..... *C25D 13/18* (2013.01); *C25D 13/02* (2013.01); *C25D 13/12* (2013.01)

(58) Field of Classification Search

CPC ..... C25D 13/18; C25D 13/02; C25D 13/12
USPC ..... 204/490
See application file for complete search history.

(56) References Cited

U.S. PATENT DOCUMENTS

| | | | | |
|---|---|---|---|---|
| 6,284,114 | B1 | 9/2001 | Chechik et al. | |
| 2004/0136047 | A1* | 7/2004 | Whitehead et al. | 359/296 |
| 2005/0164103 | A1* | 7/2005 | Kornbrekke et al. | 430/32 |
| 2008/0316578 | A1* | 12/2008 | Karasawa et al. | 359/291 |
| 2009/0009852 | A1 | 1/2009 | Honeyman et al. | |
| 2009/0288952 | A1 | 11/2009 | Olevsky et al. | |
| 2011/0175939 | A1* | 7/2011 | Moriyama et al. | 345/690 |

OTHER PUBLICATIONS

International Search Report for PCT/US12/26063 mailed Jun. 5, 2012.
Written Opinion of the International Searching Authority for PCT/US12/26063 mailed Jun. 5, 2012.
Hitoshi Ogihara et al., The Chemical Society of Japan, Chemistry Letters vol. 38, No. 2 (2009).

* cited by examiner

*Primary Examiner* — Kishor Mayekar
(74) *Attorney, Agent, or Firm* — Duane Morris LLP

(57) ABSTRACT

A method of altering a property of a surface includes suspending a plurality of low surface energy particles in a solvent, agglomerating the suspension of particles, and subjecting the suspension of particle agglomerates to electrophoretic deposition onto a substrate for a predetermined time. The altered surface may be superhydrophilic or superhydrophobic.

34 Claims, 9 Drawing Sheets

(a)

(b)

(a)

(b)

(a)

(b)

(c)

(d)

ELECTROPHORETIC-DEPOSITED SURFACES

RELATED APPLICATION

This application claims priority to U.S. Provisional Patent Application No. 61/445,432 filed on Feb. 22, 2011.

TECHNICAL FIELD

Aspects of the present disclosure relate to surfaces of materials and methods of making superhydrophobic and superhydrophilic surfaces.

BACKGROUND

Hydrophobicity is the physical property of being water-repellent; hydrophobic materials tend not to dissolve in, mix with, or be wetted by water. Hydrophilicity is the opposite property of having an affinity for water and a tendency to dissolve in, mix with, or be wetted by water. The degree of hydrophobicity or hydrophilicity of a surface can be determined by measure the angle the water forms in contact with the surface. Water contact angles can range from close to 0° to 30° on a highly hydrophilic surface, or up to 90° for less strongly hydrophilic surfaces. If the surface is hydrophobic, the contact angle will be larger than 90°. On highly hydrophobic surfaces, water contact angles can be as high as ~120°. Some materials, which are called superhydrophobic, can have a water contact angle of 150° or greater.

Superhydrophilic surfaces can be used to produce articles having anti-icing and/or anti-fogging properties, which can make them an ideal coating for airborne and ground-borne vehicle applications. Conversely, superhydrophobic surfaces can be self cleaning, i.e., water droplets simply roll of them, dissolving and removing any dust or debris present on the surface. Hence, they could be ideal as coating on windows, traffic lights and other surfaces that that should be kept clean. Other applications can include prevention of adhesion of snow to antennas, the reduction of frictional drag on ship hulls, anti-fouling applications, stain-resistant textiles, minimization of contamination in biotechnological applications and lowering the resistance to flow in microfluidic devices.

SUMMARY

In one embodiment, a method of altering a property of a surface includes suspending a plurality of low surface energy particles in a solvent, agglomerating the suspension of particles, and subjecting the suspension of particle agglomerates to electrophoretic deposition onto a substrate. The altered surface may be superhydrophilic or superhydrophobic.

In another embodiment, a surface includes a plurality of low surface energy or high surface energy particles agglomerated and controllably electrophoretically co-deposited with a binding agent onto a surface of a substrate resulting respectively, in a superhydrophobic or superhydrophilic surface.

BRIEF DESCRIPTION OF THE DRAWINGS

FIG. 10*b* is a 40×40 μm Atomic Force Microscopy (AFM) image of the deposition surface. FIGS. 10*c-e* are SEM images of the deposition surface at (c) 100 μm scale, (d) 1 μm scale, (e) 100 nm scale.

FIG. 12*a* is a superhydrophobic surface by EPD, and FIG. 12*b* is a mixed wetting surface by the combined BDA/EPD process.

DETAILED DESCRIPTION

Figure 1:
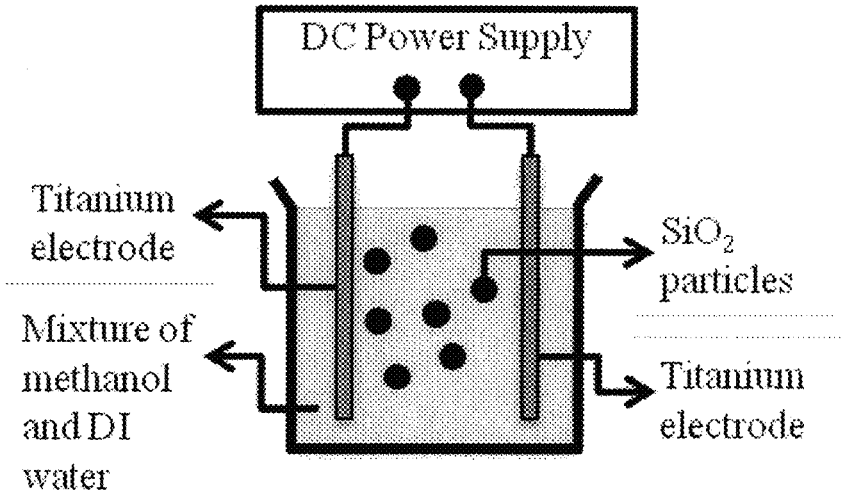
FIG. 1 is a schematic depiction of an Electrophoretic Deposition (EPD) cell.

In general, hydrophilic surfaces attract water; hydrophobic surfaces repel water. Electrophoretic deposition (EPD) may be used to fabricate surfaces having altered properties, for example, superhydrophobic surfaces or superhydrophilic surfaces. EPD may be readily scaled and/or customized, and may be a relatively low cost surface manufacturing process. Low surface energy materials with high surface roughness may be achieved using EPD of unstable hydrophobic $SiO_2$ particles suspensions. The effect of suspension stability on surface roughness may be quantitatively explored with optical absorbance measurements (e.g., to determine suspension stability) and atomic force microscopy (e.g., to measure surface roughness). Varying suspension pH may modulate suspension stability and allow surfaces to be controllably produced. Superhydrophobic surfaces may favor mildly unstable suspensions since they result in high surface roughness. Particle agglomerates formed in unstable suspensions lead to highly irregular films after EPD. After only one minute of EPD, surfaces may be obtained with low contact angle hysteresis and static contact angles exceeding 160° . Adding a polymeric binder to the suspension prior to EPD may enhance the mechanical durability of the superhydrophobic surfaces. To produce superhydrophilic surfaces with low (near zero) contact angles, we can use the same mechanism of EPD to produce porous and rough surfaces by controlling suspension stability. However, for superhydrophilic surfaces high surface energy particles should be utilized. To achieve high surface energy, titanium dioxide and silicon dioxide nanoparticles have been widely used.

In certain embodiments, agglomerating the suspension of particles may include adjusting an electric field, pH, ionic strength, solvent composition, or temperature of the suspension of particles to predetermined values. In other embodiments, the method may include subjecting the suspension to the substrate for a predetermined time. In some embodiments, adjusting the pH may include adding an acid or a base. In certain circumstances, subjecting the suspension of particles to electrophoretic deposition onto a substrate may include subjecting the suspension of particles mixed with a bonding additive to electrophoretic co-deposition onto a substrate.

The solvent may be an aqueous solvent or a non-aqueous solvent, for example, a mixture of an alcohol and water. The alcohol may be methanol or ethanol.

A bonding additive may include an epoxy, such as a conductive epoxy, a polymer, photoactive or a cellulosic material.

The particles may be polymer-coated particles. The polymer may be, for example, polydimethylsiloxane. In certain circumstances, the particles may be alkylsilane-coated particles. The particles may include ceramic particles, metallic particles, semiconductor particles, carbon nanotubes, carbon black, quantum dots, amorphous materials, nanowires, or polymers. The substrate may include titanium, aluminum, stainless steel, gold, silver, brass, bronze, cast iron, copper, nickel, platinum, iron, tungsten, or any alloys or mixtures thereof.

In another aspect, a system for altering a property of a surface includes a first electrode, a second electrode opposite the first electrode, a power supply connected to the first electrode and the second electrode, a suspension of a plurality of low surface energy or high surface energy particles in a solvent within which the first electrode and the second electrode are immersed and a deposition substrate. In certain circumstances, the electrode may include an electrically conductive substrate. In some embodiments, at least one of the first electrode or second electrode may be also the deposition substrate. In some circumstances, substrate may include water permeable polymer membranes such as NAFION®, metal mesh, metal wires, metal rods, fabric and textiles, titanium, aluminum, stainless steel, gold, silver, brass, bronze, cast iron, copper, nickel, platinum, iron, tungsten, or any alloys or mixtures thereof. In other circumstances, the first electrode and second electrode, independently, may include titanium, aluminum, stainless steel, gold, silver, brass, bronze, cast iron, copper, nickel, platinum, iron, tungsten, or any alloys or mixtures thereof. The power supply may be a DC power supply or an AC power supply.

A number of surfaces in nature use extreme water repellency for specific purposes; be it water striding or self cleaning. A number of surfaces encountered in nature are superhydrophobic, displaying water (surface tension $\gamma$=72.1 mN/m) contact angles (WCA) >150°, and low contact angle hysteresis. The most widely-known example of a superhydrophobic surface found in nature is the surface of the lotus leaf It is textured with small 10-20 micron sized protruding nubs which are further covered with nanometer size epicuticular wax crystalloids.

Multilayer thin films containing nanoparticles of $SiO_2$ may be prepared via layer-by-layer assembly. Multilayer assembly of $TiO_2$ nanoparticles, $SiO_2$ sol particles and single or double layer nanoparticle-based anti-reflection coatings may be used. Incorporation of $TiO_2$ nanoparticles into a multilayer thin film may improve the stability of the superhydrophilic state induced by light activation.

Nanoparticles may be applied to the multilayer, to provide a nanometer-scale texture or roughness to the surface. The nanoparticles may be nanospheres such as, for example, silica nanospheres, titania nanospheres, polymer nanospheres (such as polystyrene nanospheres), or metallic nanospheres. The nanoparticles may be metallic nanoparticles, such as gold or silver nanoparticles. The nanoparticles may have diameters of for example, between 1 and 1000 nanometers, between 10 and 500 nanometers, between 20 and 100 nanometers, or between 1 and 100 nanometers. The intrinsically high wettability of silica nanoparticles and the rough and porous nature of the multilayer surface establish favorable conditions for extreme wetting behavior.

To date, dozens of fabrication methods have been investigated to produce superhydrophobicity. Manufacturing demands for superhydrophobic surfaces include process simplicity, low manufacturing cost, environmental compatibility (i.e. non-toxic), scalability, and potential for mass production. Electrophoretic deposition (EPD) is a potential tool to produce superhydrophobic surfaces. EPD employs electrophoresis of charged particles in dielectric solvents to create dense porous films and structures. When a sufficient electric field is supplied to a colloidal suspension, charged particles are attracted to and deposit upon the oppositely charged electrode. Among many applications, EPD has been investigated to fabricate microscale and nanoscale structures.

EPD has also been explored to develop novel electrodes and catalyst layers for electrochemical systems, since EPD is considered as an effective technique to control porosity, surface area, and density of porous films.

EPD is a well-established process, but wettability of structures fabricated with EPD has largely been overlooked. The wettability of thin films produced by EPD with titanate nanotubes was investigated. The surface of the titanate deposition layer was switched from superhydrophilic to superhydrophobic after a surface modification with 1H,1H,2H,2H-perfluorooctyltriethoxysilane. The porous structure of the titanate deposition layer may be considered a factor to produce superhydrophobicity, but EPD itself was not investigated as a tool to control wettability. Recently, the possibility of using EPD to fabricate superhydrophobic surfaces was demonstrated. Several hydrophobic particles including carbon black, activated carbon, vapor-grown carbon nanofibers, titanium dioxide, beta-type copper phthalocyanine, and phthalocyanine green may be used to produce superhydrophobic surfaces. However, the mechanisms to control wettability with EPD or address the relatively weak adhesion of EPD surfaces was not previously explored.

EPD may be utilized to control surface roughness and achieve superhydrophobicity. Previous EPD studies have used suspension stability, electric field, and deposition time as variables to control surface roughness of deposited films for applications in medicine and ceramics, but not wettability. Suspension stability and deposition time can enhance surface roughness for the purposes of antiwetting. The effect of colloid stability on surface wettability is explored experimentally, resulting in superhydrophobic surfaces with static contact angles exceeding 160°.

When the surface of a particle in an electrolyte is electrically charged, the particlehas an electrophoretic mobility, $\mu$. Under an applied electric field, E, the charged particle moves towards an oppositely charged electrode with the velocity, $\upsilon$, expressed by, $$\upsilon=\mu E. \tag{3}$$

The mobility, $\mu$, is a function of zeta potential, $\xi$, permittivity, $\epsilon$, and viscosity, $\eta$, of the fluid as is shown in Henry's equation, $$\mu = \frac{2\varepsilon\zeta}{3\eta}. \tag{2}$$

This equation assumes spherically shaped particle with small $r/\lambda_D$, where $\lambda_D$ is the Debye-Hückel length and r is particle radius. Particles transported to the electrode agglomerate on the surface of the electrode if the electric held is sufficiently high to induce deposition.

In EPD, suspension stability is monitored since the morphology of the deposition layer may be affected by particle agglomeration. A stable suspension results in well-dispersed particles, devoid of serious flocculation. In contrast, fast particle sedimentation is observed in unstable suspensions due to particle agglomeration. Interfacial forces between particles determine suspension stability. Two opposing forces are induced between particles in close proximity. The attraction force is commonly known as the van der Waals force and the repulsive force is due to the electrical double layer. The net interaction potential, $\Phi_{net}$, is the summation of the attractive potential, $\Phi_A$, and the repulsive potential, $\Phi_R$, between two particles. Assuming spherical particles of identical size, the interaction potential can be expressed as, $$\Phi_{net} = \Phi_R + \Phi_A = 64k_B n_\infty T\lambda_D \frac{\zeta_0^2}{e^{d/\lambda_D}} - \frac{A}{12\pi d^2}, \tag{3}$$

where A is the Hamaker constant, d the distance between particles, $k_B$ the Boltzmann constant, T the absolute temperature, and $n_\infty$, the bulk ionic concentration expressed as the number of ions per cubic meter. $\xi_0$ is a function of the surface potential, $\psi_0$, defined as, $$\zeta_0 = \frac{e^{2c\psi_0/2k_BT} - 1}{e^{2c\psi_0/2k_BT} + 1}, \tag{4}$$

where c is the elementary electric charge, and z the valence number. Surface potential is directly proportional to the zeta potential such that we can consider the electric repulsion a function of the zeta potential. To evaluate suspension stability experimentally, the stability ratio, W, is employed and expressed by, $$W = \frac{K_r}{K_s} = \frac{\int_0^\infty \frac{e^{\Phi_{net}(s)/k_BT}}{s^2} ds}{\int_0^\infty \frac{e^{\Phi_A(s)/k_BT}}{s^2} ds} \tag{5}$$

Here, $K_r$ is the rate constant for rapid coagulation, $K_s$ the rate constant for slow coagulation, and s is the ratio of the particle radius to the distance between two-particle centers. Equation (5) assumes that fast coagulation occurs when the attraction force dominates and electric double layer repulsion is negligible.

From equations (2) and (5), it is notable that the zeta potential, which can be determined experimentally, influences both deposition rate and stability. In general, higher zeta potential leads to higher deposition rate and improved stability. The effects of pH, ionic concentration, surfactants, and solvent composition on stability have already been investigated. In this work, we chose to vary stability by varying suspension pH at a specified. ionic concentration, since the zeta potential is a strong function of pH.

The suspension stability can be varied to deposit different morphologies of materials on a surface or a substrate. Suspension stability can affect agglomerate particle sizes in the suspension, sedimentation speed of particles in the suspensions, nanostructures and microstructures of deposition layers, nanoscale and microscale surface roughness of deposition layers, and nanoscale and microscale porosity of deposition layers.

The electrophoretic deposition process used to form a superhydrophobic coating on surfaces. A superhydrophobic surface can include multiple layers of randomly oriented particles to provide high surface roughness. High roughness can be micrometer scale roughness. The high roughness surface can have an RMS roughness of 100 nm, 150 nm, 200 nm, 300 nm, 400 nm, 500 rim, 600 nm, or greater. For example, in the case of 14 nm PDMS coated $SiO_2$ particles, contact angles around 165° can be achieved with RMS surface roughness of around 500 nm (400 nm-600 nm). The high roughness surfaces are produced directly through EPD. Appropriate selection of conditions (e.g., pH, temperature, processing time) can promote formation of surface roughness including micropores, nanopores, or a combination thereof. A nanopore has a diameter of less than 150 nm, for example, between 10 and 100 nm. A nanopore can have diameter of less than 100 nm. A micropore has a diameter of greater than 150 nm, typically greater than 200 nm. Selection of pore forming conditions can provide control over the porosity of the coating.

For example, a method of altering surface roughness can include varying electrophoresis deposition time. Varying the time electric potential is supplied to the electrodes submerged in the particle suspension alters the deposition time. The deposition time can affect one or more of the microstructure and macrostructure of deposition layers, surface roughness of deposition layers, or the thickness of deposition layers. The suspension can be deposited onto the substrate for a predetermined amount of time. For example, the deposition time can be 30 s, 60 s, 90 s, 120 s, 150 s, 180 s, 210 s, 240 s, 270 s. or 300 s. The to specific deposition time to obtain a maximum contact angle can depend on the composition of suspensions and the electric potential. The specific time can be determined and is repeatable. For example, when the solvent is composed of water 10% and methanol 90% in volume and the electric potential is 10 V with the PDMS coated $SiO_2$ particles, deposition times can range between 10 s to 5 min.

In another example, a method of altering surface roughness can include varying the applied electric field. The electric field can be varied by, for example, varying the magnitude of the applied potential, varying the frequency of time dependent electric potentials, varying the distance between electrodes, or combinations thereof.

In another example, a method to altering surface roughness can include varying particle size. For example, the suspension can consist of particles with a homogeneous size distribution, the suspension can consist of particles with a heterogeneous size distribution, or the suspension can include multiple size particles of different particle compositions, shapes and/or surface modification. In certain circumstances, different size particles can have the same surface energy or different surface energies. In some circumstances, when multiple size particles are present, the surface of larger particles can be coated with smaller particles. During deposition, different size particles can be deposited at the same time or with series of depositions.

In one embodiment, altering surface roughness may be achieved by changing its microstructure. Break down anodization (BDA) and hybrid electrophoretic deposition END may be used to prepare heat transfer surfaces. In the BDA process, the pH of DI water was adjusted to pH 3 with acid (Nitric acid, 70% ACS reagent, Sigma-Aldrich). Two titanium plates (Titanium foil (99.7%), 0.05 mm Thickness) may be used as cathode and anode electrodes and electric potentials up to 90 V may be applied for 10 min. For the EPD method, commercially available PDMS modified $SiO_2$ nanoparticles (14 nm, PlasmaChem) in a mixture of 90% methanol and 10% DI water by volume may be used to make 1 g/L concentration $SiO_2$ suspensions. Titanium plates may be again used as anode and cathode electrodes. An electric field of 30 V/cm was subjected to the electrodes for 30 seconds to deposit nanoparticles on the substrate. Ultimately three kinds of heat transfer surfaces may be prepared, superhydrophobic, superhydrophilic, and mixed wettability surfaces. Superhydrophobic surfaces and superhydrophilic surfaces may be produced by the EPD and BDA processes, respectively. Both BDA and EPD may be employed to create the mixed wettability surface.

In another embodiment, a method of altering surface energy can include varying particle composition. For EPD of superhydrophilic surfaces, $TiO_2$ nanoparticles (20 nm, anatase, Sigma-Aldrich) were used with acetic acid as solvent. 1 g/L concentration $TiO_2$ suspensions were prepared for EPD. Titanium plates (Ultra-Corrosion-Resistant Titanium Grade 2, 0.020" Thick) were used as anode and cathode electrodes. An electric potential of 30 V/cm was subjected to the electrodes to deposit particles on the substrate for 30 sec.

Capillary rise experiments may be used to evaluate the superhydrophilicity of the prepared surfaces in terms of capillary pressure and spreading speed. In summary, the capillary pressure, $P_{cap}$, can be calculated from the maximum capillary height using the equation of $P_{cap}=[2\gamma \cos \theta/R]=H_{max}g\rho$, where $H_{max}$ is the maximum capillary rise height, $\gamma$ is liquid surface tension, 0 is a native contact angle, and $\rho$ is the liquid density. The spreading speed constant, $\upsilon_{cap}$, can be obtained from the equation $h^2=[R\gamma \cos \theta 2\eta]l=\upsilon_{cap}t$, where h is the rise height, $\eta$ is the liquid viscosity, and t is time. The morphologies of prepared surfaces may be characterized with a scanning electron microscope (SEM). A goniometer may be used to dispense and image 3 μL drops of DI water on each sample. Static contact angles (CA) may be calculated using the tangential curve-fitting method. A digital camera may be used to record bubble dynamics on the heat transfer surfaces.

SEM images in FIG. 12 illuminate the mixed behavior of a sample. Nanoporous layers in FIG. 12*a* are observed with the samples produced by EPD. The dual scale micro and nano porous structures in FIG. 12*b* may be produced by a hybrid method of a combined BDA/EPD process. Static contact angles were measured on the prepared surfaces. Immediately following contact with water, the surfaces displayed contact angles near zero degrees. In depth evaluation of the superhydrophilic surfaces consisted of measuring liquid spreading speeds and capillary pressures with capillary rise experiments. The resulting surfaces showed high capillary pressures and fast spreading speed constants. This reveals that EPD method can effectively produce superhydrophobic surfaces and superhydrophilic surfaces depending upon the surface energy of the particles deposited.

In another example, a method of altering contact angles of surfaces can include varying surface energy of the particles used in electrophoresis deposition. In certain circumstances, surface energy can be altered by changing the chemical composition of particles, by surface treatment of particles with before or after electrophoresis deposition or by coating particles with other particles that have different surface energy. The deposition can be parallel to the direction of gravity. In other circumstance, the deposition can be against the direction of gravity.

Particles can be applied to the surface to provide a texture or roughness to the surface. The particles can be ceramic particles, metallic particles, semiconductor particles, carbon nanotubes, carbon black, quantum dots, amorphous materials, nanowires, or polymers, such as, for example, silica, titania, polymer mircrospheres or nanospheres (such as polystyrene nanospheres), or metallic nanoparticles (such as gold or silver particles). The particles can have average diameters between 1 nanometer and 10 micrometers. The particles can he nanoparticles, which can have diameters of, for example, between 1 and 1000 nanometers, between 10 and 500 nanometers, between 20 and 100 nanometers, or between I and 100 nanometers. The particles can be low surface energy particles or high surface energy particles. Surface energy physically means the work to overcome the attractive force between two surfaces. Low surface energy particles mean that the flat surface which has the same chemical composition of the particles has the contact angle higher than 90°. For example, PDMS flat surfaces show the contact angle of 100-110°, therefore PDMS coated $SiO_2$ particles are considered to have the low surface energy. In contrast, high surface energy particles mean that the flat surface which has the same chemical composition of the particles has the contact angle less than 90°. For instance, polystyrene is a reprehensive hydrophilic material which has contact angles less than 90°, therefore polystyrene coated particles are considered to have high surface energy. The particles can obtain a surface charge when dispersed in a solvent. The particles can be fullerenic carbon nanotubes. The particles can be oxide ceramics such as $SiO_2$, $TiO_2$, and $ZrO_2$, non-oxide ceramics such as GaSb and GaAs, metal particles such as palladium, silver, or quantum dots such as CdSe/ZnS.

Electrophoretic deposition can be used to make a superhydrophobic surface from a suspension of particles. The suspension can include a plurality of low surface energy particles in a solvent. The particles can also undergo surface modification before being incorporated into a superhydrophobic surface. For example, the particles can be coated with a hydrophobic material such as an organosilane, including an alkylsilane or siloxane such as a lower alkyl silane (e.g., oetylsilane), polymethylsiloxane (PDMS), polydiphenylsiloxane, octadodecyldimethylchlorosilane (OCD), trichloro (1H,1H, 2H,2H-perfluorooctyl)silane, perfluoroalkysilane, hexametyldisiloxane (HMDSO) monomer or fluorosilane, a hydrocarbon such as a halogenated polymer fluoropolymer (C4F8) or poly-(tetrafluoroethylene) (PTFE), a long chain alkyl thiol such as n-dodecanethiol, 1-hexadecanethiol or n-octadecyl mercaptan, or other hydrophobic organic material such as poly(N-isopropylacrylamide), alkylketene dimer (AKD), carbon tetrafluoride (CF4), perfluoroalkyl methacrylic copolymer, n-dodecanethiol, fluoroalkylsilane, or $HS(CH_2)_{11}CH_3$.

The stability of the suspension of particles can be adjusted by varying the pH, salt concentration, particle concentration, solvent composition, temperature, or a combination thereof. For example, the pH can be adjusted to 3.0, 4.0, 5.0, 6.0, 7.0, 7.4, 7.6, 7.9, 8.0, and 8.3. The pH can also be adjusted to any specific pH between 2.0 and 10.0. The pH can be lowered by adding an acid such as nitric acid ($HNO_3$), hydrochloric acid (HCl), or sulfuric acid ($H_2SO_4$). The pH can be raised by adding a base such as potassium hydroxide (KOH), sodium hydroxide (NaOH), or calcium hydroxide ($Ca(OH)_2$). The salt concentration can be varied by adding salts such as potassium nitrate ($KNO_3$) or sodium chloride (NaCl). The solvent composition can be varied by altering the volume or weight ratio of aqueous solvents and non-aqueous solvents such as methanol, ethanol, isopropanol, acetone, or acetylacetone.

The temperature can be varied from freezing temperatures of the particular solvent to boiling temperatures of the particular solvent.

A substrate can be any material suitable for electrophoretic deposition, such as an electrical conductors or a non-conductor permeable to electric fields such as a porous membranes. The substrate can be substantially transparent. The substrate can include water permeable polymer membranes such as NAFION®, metal mesh, metal wires, metal rods, fabric and textiles. The substrate can also include any suitable electrically conductive substrate. For example, the substrate can include titanium, aluminum, stainless steel, gold, silver, brass, bronze, cast iron, copper, nickel, platinum, iron, tungsten, or any alloys or mixtures thereof. In certain circumstances, a method of varying surface roughness can include altering surface roughness of the deposition substrate by chemical etching, mechanical modification (e.g. scraping, scratching, or machining), or electrochemical treatment.

The electrode in the electrophoretic deposition system can be a material that is sufficiently conductive to be useful as an electrode. Titanium is one suitable material. The electrode can also include any suitable electrically conductive substrate. For example, the electrode can include titanium, aluminum, stainless steel, gold,.silver, brass, bronze, cast iron, copper, nickel, platinum, iron, tungsten, or any alloys or mixtures thereof The electrode can also be the deposition substrate.

Mechanical integrity (e.g., durability and adhesion) of a coating can be important in practical applications. A lock-in step can prevent further changes in the structure of the porous multilayer. The lock-in can be achieved by, for example, exposure of the multilayer to chemical or thermal polymerization conditions. As-assembled $TiO_2/SiO_2$ particle-based multilayers can have less than ideal mechanical properties. The poor adhesion and durability of the as-assembled multilayer films is likely due to the absence of interpenetrating components (i.e., charged macromolecules) that bridge the deposited materials together within the coatings. The mechanical properties of the coatings can be drastically improved by calcinating the as-assembled multilayers at a high temperature (e.g., 550 ° C.) for 3 hours which leads to the fusing of the particles together and also better adhesion of the coatings to glass substrates. Other methods to improve mechanical integrity include chemical crosslinking and photocrosslinking. Additionally, the addition of a bonding additive to the particle suspension prior to deposition can increase mechanical durability, at least in part because the co-deposition of particles and bonding additives produce mechanical connections of the additives between particles in the deposition layers. The bonding additive can include an epoxy, an adhesive, a polymer, a silicone, or a cellulose. For example, the bonding additive can include LOCTITE® 3106 cure adhesive, polytetrafluoroethylene (PTFE), SYLGARD® 184 silicone elastomer, or methylcellulose.

Embodiments

Hydrophobic $SiO_2$ particles polydimethylsiloxane (PDMS) coated, average particle diameter 14 nm may be used without additional purification or modification. A mixture of 90% methanol (ACS Reagent, Baker analyzed) and deionized (DI) water (by volume) was used as the solvent. The PDMS coated $SiO_2$ particles are hydrophobic, making dispersion in aqueous solvents impractical. Therefore, non-aqueous solvents may be used and methanol was chosen since its refractive index (n=1.33 at 25 ° C.) is similar to water. (Matching refractive index is critical to obtaining reliable stability ratio measurements via absorbance spectra, as explained below.) This technique to create superhydrophobic surfaces is not limited to PDMS coated hydrophobic $SiO_2$ particles and methanol based solvents as presented here. Superhydrophobic surfaces with both hydrophobic $TiO_2$ particles and $SiO_2$ particles modified by octylsilane have been obtained.

For colloid stability, zeta potential, and particle size measurements, particle concentrations of 0.1 g/L may be used. Following initial dispersion, potassium nitrate (ACS reagent, ≥99%, Sigma-Aldrich) was added to the suspension in order to adjust the salt concentration to ~$10^{-6}$M. The purpose of the salt is to vary the gradient of the zeta potential curve.

After 5 minutes of sonication (all sonication was conducted with the amplitude 0.25 μm/mL [Sonicator 400, Qsonica, LLC.]), the $SiO_2$ particles may be well dispersed in the suspension. Next, the suspension pH was adjusted with acid (Nitric acid, 70% ACS reagent, Sigma-Aldrich) or base (Potassium hydroxide, 45 wt. % solution in water, Sigma-Aldrich). Ten different pHs; 3.0, 4.0, 5.0, 6.0, 7.0, 7.4, 7.6, 7.9, 8.0, and 8.3, may be prepared for the measurements. Five minutes after the pH was adjusted, the suspension was sonicated again for 5 min. After the suspension settled for 30 s, zeta potential and particle sizes may be measured by dynamic light scattering (Zetasizer Nano ZS, Malvern Instruments, Inc.) and suspension absorbance vs. time was recorded with a spectrophotometer (Wavelength 450 nm, Spectrophotometer UV-1800, Shimadzu). Each measurement at a given pH was conducted three times with independently prepared suspensions.

Suspension stability can be quantitatively evaluated from the change of absorbance with respect to time. A stable suspension shows moderate change of absorbance due to its slow sedimentation. In contrast, unstable suspensions are more likely to have fast sedimentation attributed to the low net interaction potential between particles, as shown in equation (3). This results in a steep gradient in absorbance versus time. Change of absorbance, a, versus time is directly proportional to the initial rate constant, K for coagulation when time, t, is small, and can be expressed by, $$\frac{d\alpha}{dt} = -\frac{\kappa K_r N_0^2 \lambda^2}{(1+\kappa N_0 t)^2}. \tag{6}$$

Here $N_0$ is the initial number of particles, λ the wavelength of incident light, and $K_r$ is a proportionality constant. Experimental stability ratio can be acquired by dividing the maximum rate of change of absorbance by the rate at a particular pH, as in the following equation, $$W_{abs} = \frac{\kappa_r}{\kappa_s} = \frac{[d\alpha/dt]_{max}}{[d\alpha/dt]_{pH}} \tag{7}$$

As an alternative, changes in particle size can be employed using dynamic light scattering (DLS) measurements to assess stability.

The average hydrodynamic particle diameter, $D_h$, can be calculated by the Stokes-Einstein equation, $$D_h = \frac{k_B T}{3\pi\eta D}. \tag{8}$$

In equation (8), D is the average translational diffusion coefficient of colloidal particles in dilute suspension, which can be determined by the temporal evolution of intensity fluctuations in dynamic light scattering measurements. The change of particle size, $D_h$, with respect to time is a function of the initial aggregation rate constant $C_0$ and the initial particle concentration, $C_0$, when time, t, is small, as $$\frac{dD_h}{dt} = \beta\kappa C_0 \tag{9}$$

where, β is a constant that depends on scattering angle and material properties of particles. Noting the presence of coagulation rate in equation (9), the experimental stability ratio can be expressed in terms of the ratio of the fast coagulation rate to the slow coagulation rate, $$W_{size} = \frac{\kappa_r}{\kappa_s} = \frac{(dD_h/dt)_{max}}{(dD_h/dt)_{pH}} \tag{10}$$

If the initial particle size, $D_{h,i}$, and the maximum particle size, $D_{h,max}$, are known at a specific time t, the stability ratio based on size, $W_{size}$, can be calculated as $$W_{size} = \frac{D_{h,max} - D_{h,i}}{D_{h,pH} - D_{h,i}}. \tag{11}$$

The size based stability ratio, $W_{size}$, calculated by equation (11) should be comparable with the stability ratio, $W_{abs}$, obtained through the absorbance measurement as in equation (7). Notably, the initial particle size can be estimated by comparing both stability ratios.

The suspensions used for EPD may be prepared using the procedure indicated above except that the $SiO_2$ particle concentration was increased to 1 g/L. FIG. 1 shows a schematic of the EPD system. Two titanium plates (Purity≥99.6%, Annealed, Goodfellow Corporation), with identical dimensions of thickness (0.5 mm), width (10 mm), and length (50 mm), may be used as working and counter electrodes. In each experiment 10 V was applied between two electrodes.separated by 15 mm. The cell also includes a suspension consisting of hydrophobic $SiO_2$ particles dispersed in a mixture of 90% methanol and 10% DI water by volume. The EPD process was conducted at ambient temperature and without mechanical stirring. Deposition times may be 30 s, 60 s, 90 s, 120 s, and 180 s. After completing EPD the sample was dried in ambient air.

To improve deposit adhesion, in some cases two part conductive epoxy (CW2400, Chemtronics) was added into the suspension. After the 1 g/L $SiO_2$ suspension was prepared, 10 g/L of each epoxy was separately mixed into the suspension via 5 min of sonication. After mixing both epoxies, the EPD process was conducted immediately. A stirrer (7×7 in ceramic top plate, 1×0.5 in Teflon magnetic stirring bar, VWR) was used with a rotating speed of 1000 rpm during the EPD process in order to maintain well dispersed epoxy in the suspension. The electric potential was 30 V/cm and the deposition time was 10 min. Other conditions for the EPD process may be the same as the non-epoxy suspensions.

The morphology of deposited films was characterized with a scanning electron microscope (SEM, JEOL 6320FV Field-Emission High-resolution SEM). Surface roughness was measured by atomic force microscopy (AFM, DI Nanoscope) at three distinct points on each sample. The area scanned for AFM measurements was 40×40 μm and the average root mean square (RMS) surface roughness was calculated using commercial software provided by the AFM manufacturer. A goniometer (Kyowa, DM-CE1) was used to dispense and image 3 μL drops of DI water at four different points on each sample. Static contact angles (CA) may be calculated using thetangential curvelitting method.

The first suspension property measured was zeta potential since it is the key characteristic of a colloidal suspension. Zeta potential measurements may be conducted at ten pH values: 3.0, 4.0, 5.0, 6.0, 7.0, 7.4, 7.6, 7.9, 8.0, and 8.3. FIG. 2*a* shows zeta potential as a function of suspension pH. The isoelectric point (IEP) is roughly pH 3 for the PDMS coated $SiO_2$ particles, and zeta potential generally decreases with increasing pH. From equations (3)-(5), one would expect that particles in lower pH suspensions (<pH 7) show lower stability ratios. In addition, the deposition rate during EPD should be higher in the basic region than the acidic region due to increased zeta potential. It is worth noting that the maximum absolute value of zeta potential measured occurs at pH 8. Further, zeta potential directly affects the size of particle agglomerates in the suspension. FIG. 2*b* shows the average particle diameter as a function of pH in the suspension after sonication. As expected, particle agglomerate size decreases with higher absolute value of zeta potential due to electric double layer repulsion. Particle size at pH 8.3 was larger than pH 8.0, indicating a slightly reduced stability ratio. The error bars shown in FIGS. 2*a-b* represent two standard deviations of three measurements.

Figure 3:
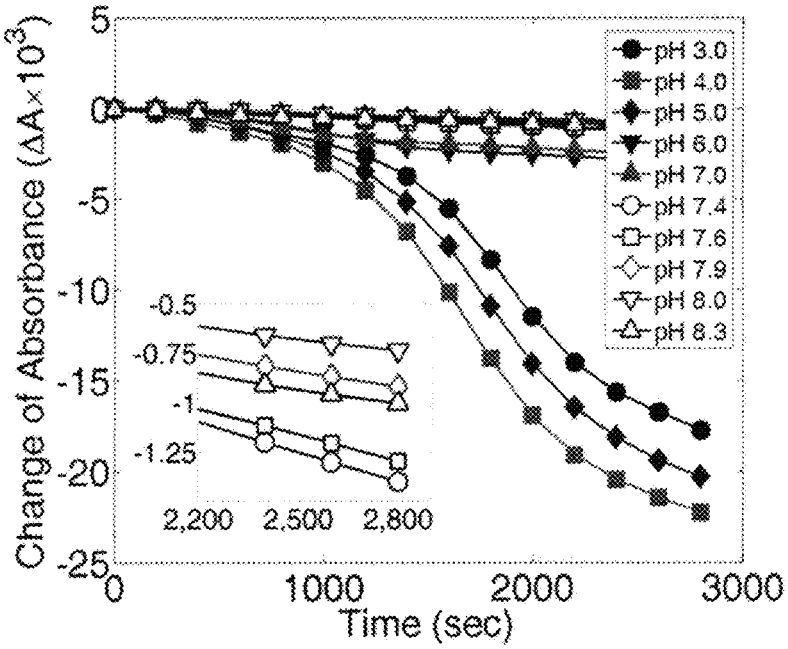
FIG. 3 is a graph illustrating the change in suspension optical absorbance as a function of time for 10 different pH suspensions with 0.1 g/L PDMS coated $SiO_2$ particle concentration.

Optical absorbance as a function of time was measured with the suspensions prepared in the zeta potential and size measurements. FIG. 3 shows the change of absorbance for each pH. A moving average filter was used to remove random fluctuations. The window of the moving average filter was 300 seconds. The absorbance results qualitatively agree with the particle size measurements since suspensions with larger particle sizes exhibit steeper absorbance changes in time. The inset shows absorbance curves for higher pH values (7.4 to 8.3). The low pH curves show fast change of absorbance, which is attributed to rapid coagulation. Using equation (3), this result can be explained by the high absolute zeta potential. High zeta potential leads to increased electrostatic repulsion, $\Phi_R$, and net interaction potential, $\Phi_{net}$, resulting in slow agglomeration. The slow agglomeration reduces both the rate of change of absorbance and the rate of particle coagulation.

Figure 4:
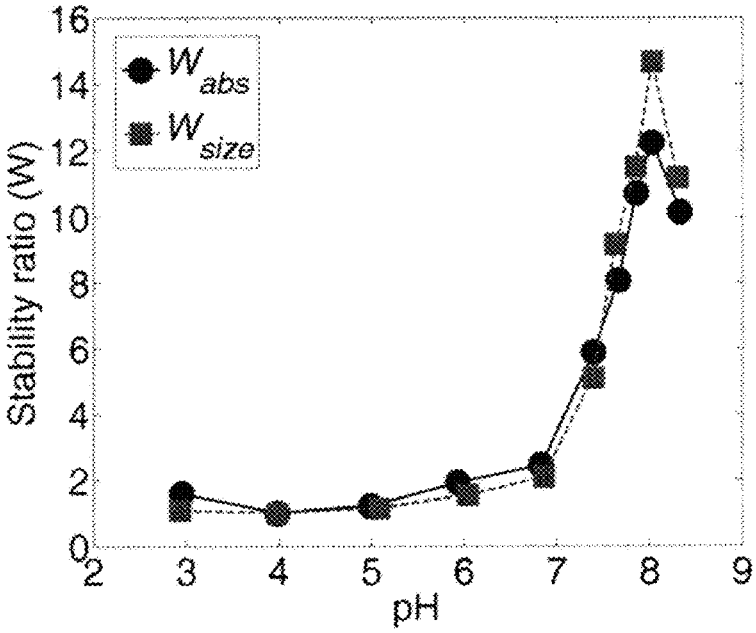
FIG. 4 is a graph illustrating the stability ratio as a function of suspension pH.

From the absorbance curves, experimental stability ratios may be calculated with equation (7). The maximum absorbance slope occurs at pH 4.0, which was used for the numerator (fast coagulation rate) of equation (7). By dividing the maximum absorbance slope by the slope at each pH, the stability ratio, $W_{abs}$, was determined, as shown in FIG. 4. For comparison, a second stability ratio based on agglomerate size, $W_{size}$, and calculated using equation (11) is given in FIG. 4. The measured particle size of 304 nm was used as the initial particle size, $D_{h,i}$, in equation (7). Both stability curves are in good agreement.

Films consisting of PDMS coated $SiO_2$ particles may be produced by EPD using four suspensions with pH 7.4, 7.6, 7.9, and 8.3. The pH values may be chosen to span a wide range of stability ratios (c.f. FIG. 4). Stable deposition layers may be not produced with suspensions having pH lower than 6.5 due to rapid coagulation and sedimentation during EPD. Since the stability ratio curve showed a steep slope at around pH 7.5, we expected the effect of stability on EPD to be most apparent in.this pH region. In addition, pH 8.3 was considered due to its lower stability value than pH 8.0 (see FIG. 4). For EPD, the suspensions may be prepared using the same procedure employed for the zeta potential and stability tests. However, the concentration of PDMS coated $SiO_2$ particles was increased to 1 g/L in order to reduce deposition time. Stability ratios at higher particle concentration (not shown) displayed similar trends to the 0.1 g/L data shown in FIG. 4.

Figure 5:
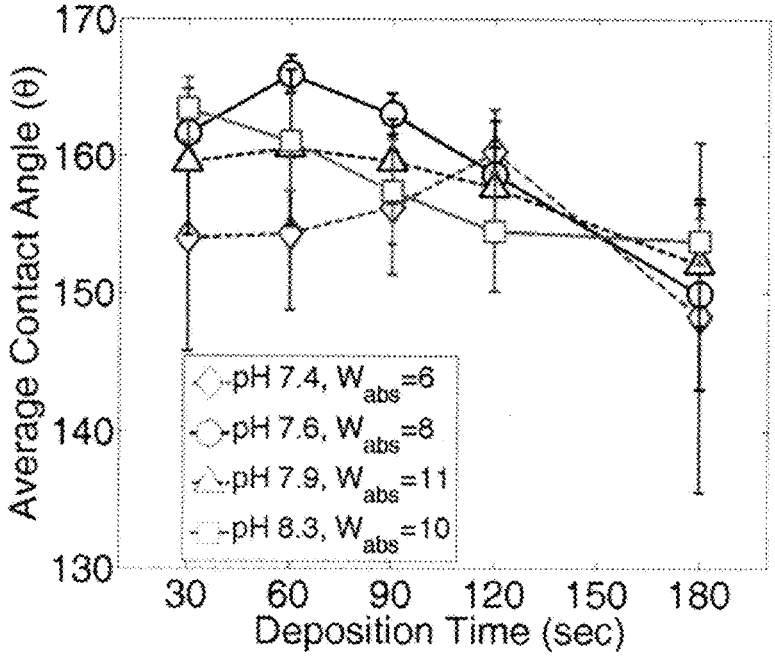
FIGS. 5*a-b* are graphs illustrating contact angles on films deposited via EPD.
Figure 5:
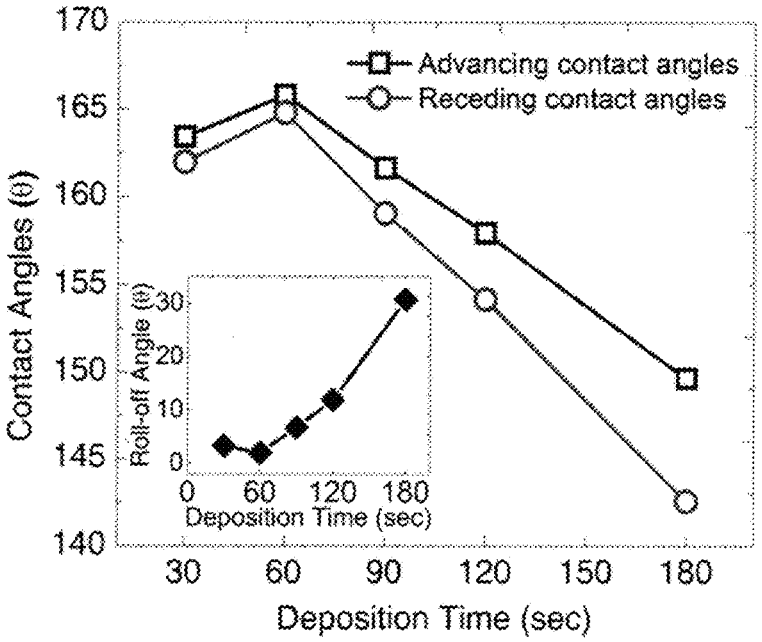

FIG. 5*a* shows static contact angle on EPD modified surfaces as a function of deposition time and suspension pH. Contact angles may be calculated by the tangential method with 3 μL water droplets. The maximum contact angles for each pH may be 160° at pH 7.4, 166° at pH 7.6, 161° at pH 7.9, and 163° at pH 8.3. The highest contact angle was produced at 7.6 after 60 s of EPI). Suspensions with higher stability ratios may be unable to obtain higher contact angles than the pH 7.6 suspension. It is interesting to note that the pH 8.3 suspension produced higher contact angles than the pH 7.9 suspension. This is further evidence that contact angle is highly dependent upon suspension stability. Dynamic contact angles may be measured on the films produced at pH 7.6 as a function of deposition time, as shown in FIG. 5*b*. The difference between advancing and receding contact angles is considered a more reliable method to evaluate superhydrophobicity since water-repellant surfaces can be evaluated strictly by contact angle hysteresis. The roll-off angle, $\alpha_R$ □ of water droplets can he calculated with the equation $\alpha_R=\sin^{-1}\{\gamma_{LV}m^{-1}\cdot g^{-1}\cdot w\cdot(\cos\theta_R-\cos\theta_A)\}$, where m and w are the mass and width of the droplet, $\gamma_{LV}$ the surface tension of water, g the gravitational acceleration, and $\theta_A$ and $\theta_R$ are advancing and receding contact angles, respectively. In the surfaces prepared at pH 7.6, the calculated roll-off angles shown in the inset of FIG. 5*b* may be 3°, 2°, and 7° for 30 s, 60 s, and 90 s deposition times, respectively. Roll off angles less than 10° indicate that the surfaces can be regarded as superhydrophobic in terms of both static and dynamic contact angles. The error bars shown in FIG. 5*a* represent two-standard deviations of twelve measurements at each point. The maximum contact angle was achieved at pH 7.6, corresponding to a stability ratio of $W_{abs}=8$ and deposition time of 60 s.

Figure 2:
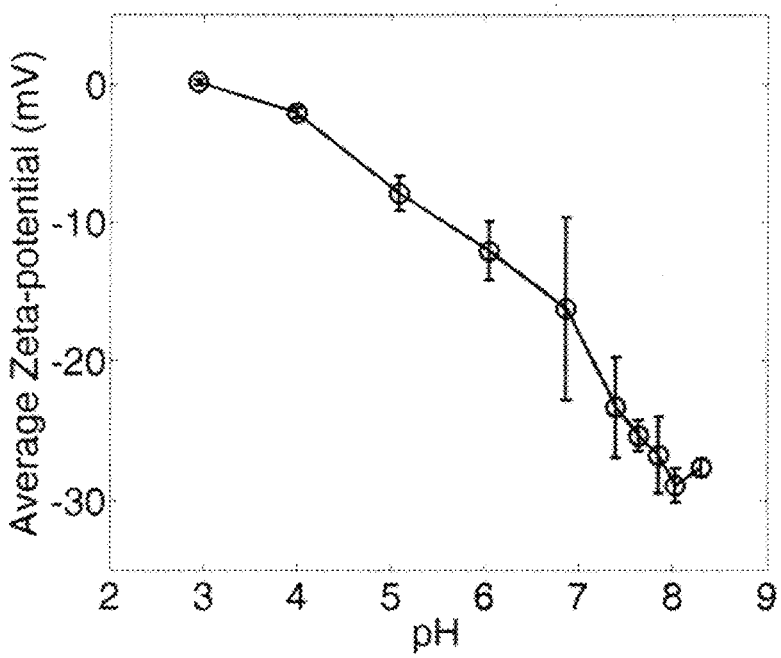
FIGS. 2*a-b* are graphs illustrating the characterization of polydimethylsiloxane (PDMS) coated $SiO_2$ particles as a function of pH.
Figure 2:
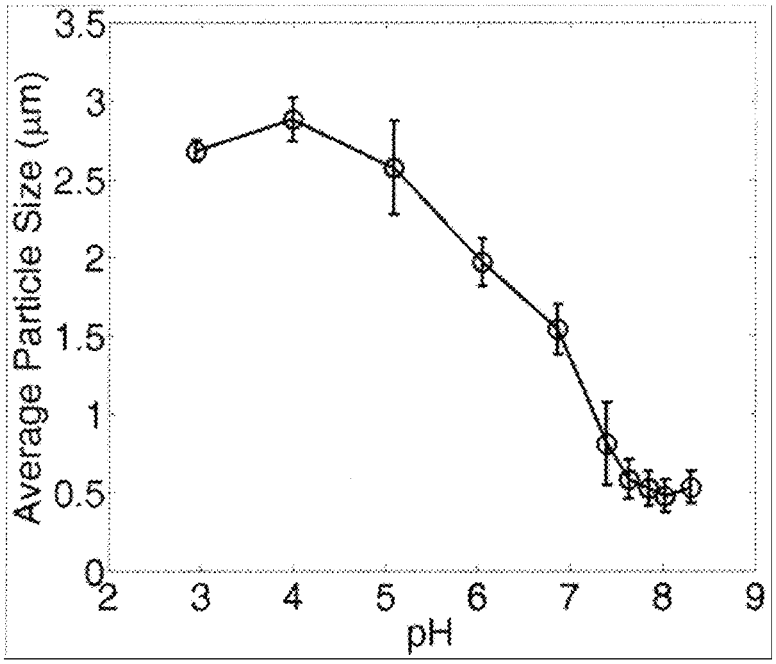
Figure 6:
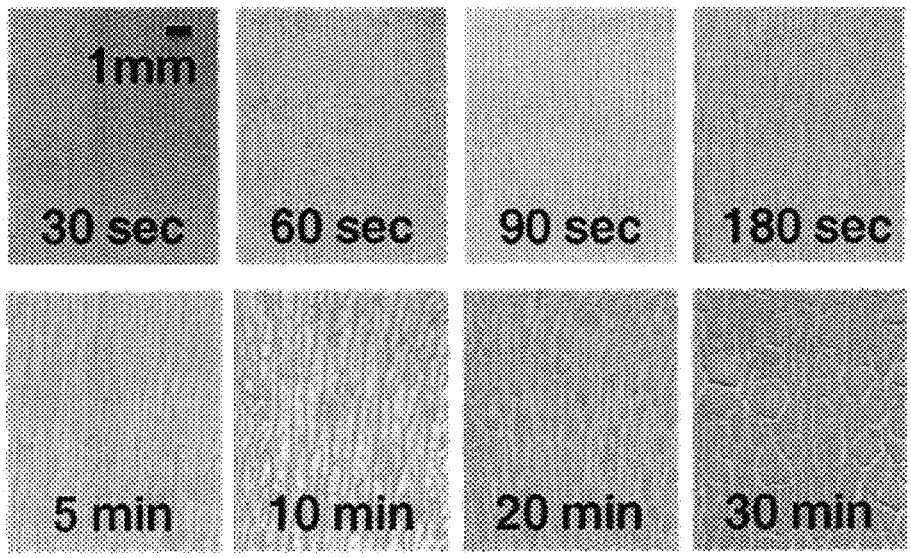
FIG. 6 includes images illustrating patterns of EPD films produced by the pH 7.9 suspension with different deposition times.

Surfaces produced at pH 7.4 showed the highest standard deviation in measured contact angle over the range of deposition times. This could be explained by the zeta potential and particle size measurements shown in FIG. 2, which also displays high variation at pH7.4. In addition, each suspension has a maximum contact angle as a function of deposition time. Interestingly, there is an optimal deposition time to acquire maximum contact angle for each pH. The film produced by the pH 7.4 suspension has the slowest increase of contact angle with deposition time due to its low deposition rate compared to the higher pH suspensions. To explain the observed optimum deposition time we consider the influence of microscale and nanoscale features on surface energy. Lee et al. presented the role of microscale and nanoscale features on wettability. Their work showed that contact angle increases with longer nanofibers but there was an optimal microstructure length scale to maximize the contact angle. Their observed results resemble the present study, given that suspension stability and deposition time affect nanoscale and microscale features, respectively. With EPD, nanoscale surface features are controlled by suspension stability since the agglomerate particle size (order 100 nm) increases with decreasing stability, as shown in FIG. 2*b*. Meanwhile, the role of the deposition time is shown in FIG. 6. Here, EPD surfaces produced at pH 7.9 are observed as a function deposition time (30 s to 30 min). All images have the same scale bar in the top and most left picture. Patterns on the substrate grow with deposition time, indicating that deposition time influences the micro/macro length scales of the surface. A similar phenomenon has been reported in an EPD process to produce thin and porous alumina membranes. They found that the porosity of deposited films decreased after a specific deposition time. In their experiments, the pore structures became smaller and denser after a critical deposition time as the deposition mechanism changed from vertically stacked particles to horizontally organized structures, resulting in decreased pore size. Deposition features grow with deposition time, resulting in a decrease in contact angle when deposition time exceeds 60 s. Porosity and surface roughness are comparable with one another and we attribute both decreases after a specific deposition time to the increased length scale of deposits.

Figure 7:
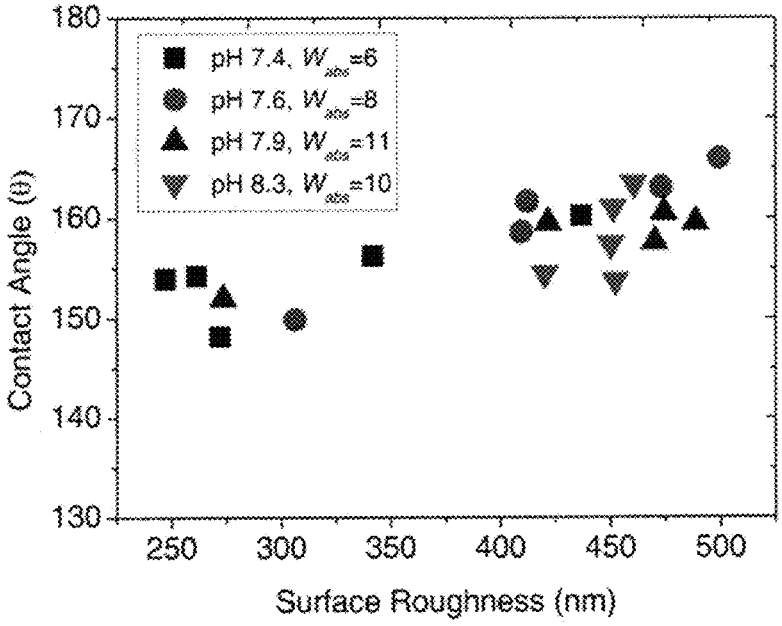
FIG. 7 is a graph illustrating the contact angle as a function of Root Mean Square (RMS) surface roughness.

To reveal the mechanism underlying the varying contact angles, surface roughness of the deposited films may be measured for each pH. FIG. 7 shows contact angles with respect to surface roughness for the EPD samples. In surface roughness measurements, the measured area was 40×40 μm and three point values may be averaged in each sample. As shown, contact angle tends to increase with increasing surface roughness. The relation between contact angles and surface roughness for heterogeneous wetting is given by the Cassie equation, $\cos\theta=f_s\cos\theta_E-f_a$. The contact angle on a rough surface, θ, is a function of the native contact angle, $\theta_E$, of the flat surface, the solid area fraction, and the vapor area fraction, $f_a$, on the rough surface. The Cassie model assumes that the droplet is positioned on the roughened surface without wetting the porous structure. This function can also be expressed as $\cos\theta=-1+f_s(\cos\theta_E+1)$ since $f_s+f_a=1$. This means that higher surface roughness leads to higher contact angle when the contact angle on the flat surface exceeds 90°. The native contact angle of PDMS, the material encapsulating the $SiO_2$ particles used in this study, is 100-112°, therefore the result of FIG. 7 is consistent with Cassie's theory.

The deposition layer created at pH 7.6 had the highest surface roughness and contact angle, while the pH 7.4 suspension showed the lowest values. This behavior is qualitatively explained in FIG. 8. In the case of 7.4, the large coagulated particles prevent the creation of thick films due to the low electrophoretic force relative to sedimentation, limiting surface roughness. In the case of pH 7.6, coagulated particles, which are smaller than 7.4 agglomerates, are reasonably well dispersed in the suspension and have sufficient concentration to produce thick layers. Multiple layers of randomly oriented coagulated particles provide high surface roughness and therefore high contact angle. However, at pH 7.9, the deposition layer results in lower surface roughness than the pH 7.6 case because smaller coagulates yield a more ordered deposition surface. Though the thickest deposition layers are achieved with the p1.1 7.9 suspension, the increased stability leads to reduced surface roughness.

Figure 8:
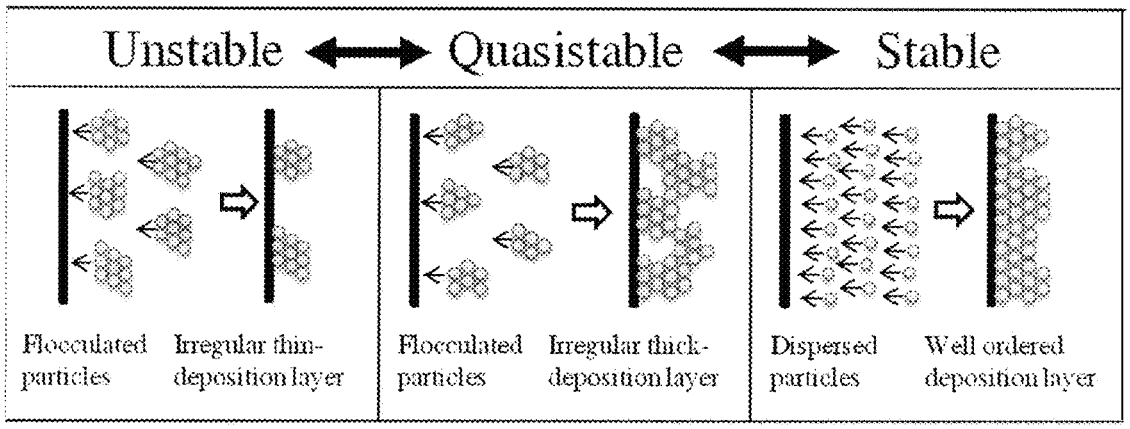
FIG. 8 is a qualitative schematic of deposition behavior with respect to suspension stability.
Figure 9:
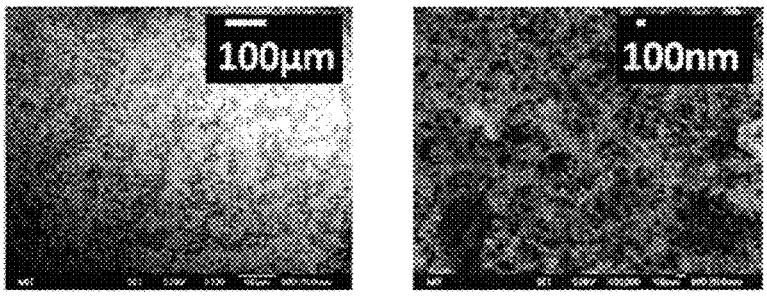
FIGS. 9*a-d* are Scanning Electron Microscope (SEM) images at two different magnifications of deposited films yielding maximum contact angles at (a) pH 7.4, (b) 7.6, (c) 7.9, (d) 8.3.
Figure 9:
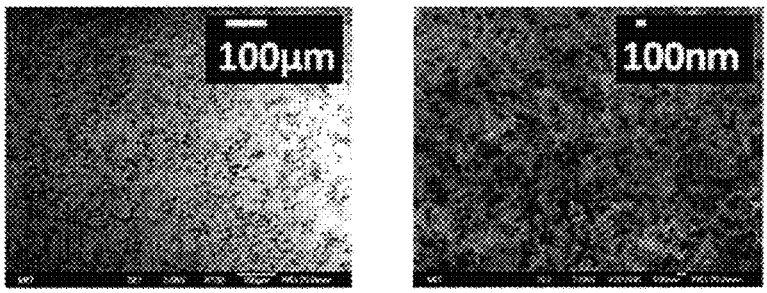
Figure 9:
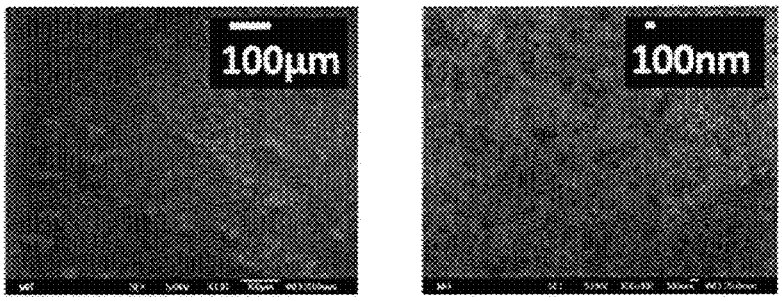
Figure 9:
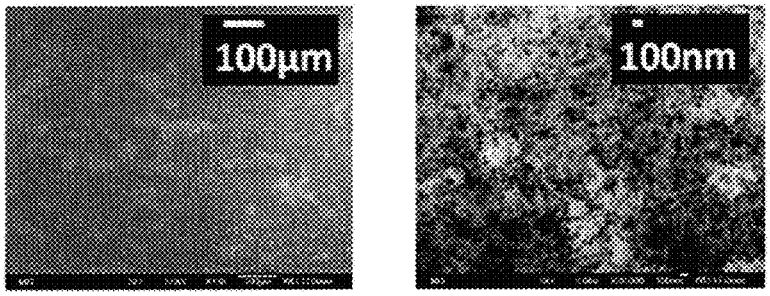

To verify the mechanism explained in FIG. 8, SEM images may be taken of EPD sample surfaces (FIG. 9). From the SEM images, we find that the most uniform deposition layer, with full substrate coverage, is produced at pH 7.9. At pH lower than 7.9, large islands of deposited particles appear in a random orientation on the substrate. For example, the pH 7.4 sample in FIG. 9*a* showed the largest coagulated-particles and the least surface coverage. As pH increases, the film becomes increasingly uniform, consistent with stability measurements of FIG. 4.

In most EPD applications, weak adhesion between particles and the substrate must be addressed in order to obtain robust surfaces. Here, conductive epoxy was used to enhance mechanical durability without degrading the low energy surfaces obtained during EPD of PDMS coated $SiO_2$ particles. In other studies, various polymers have been used as binders in order to enhance adhesion and avoid cracks in the film, resulting in high mechanical stability. However, longer deposition time may be required due to the high suspension conductivity obtained after adding conductive epoxy.

Figure 10:
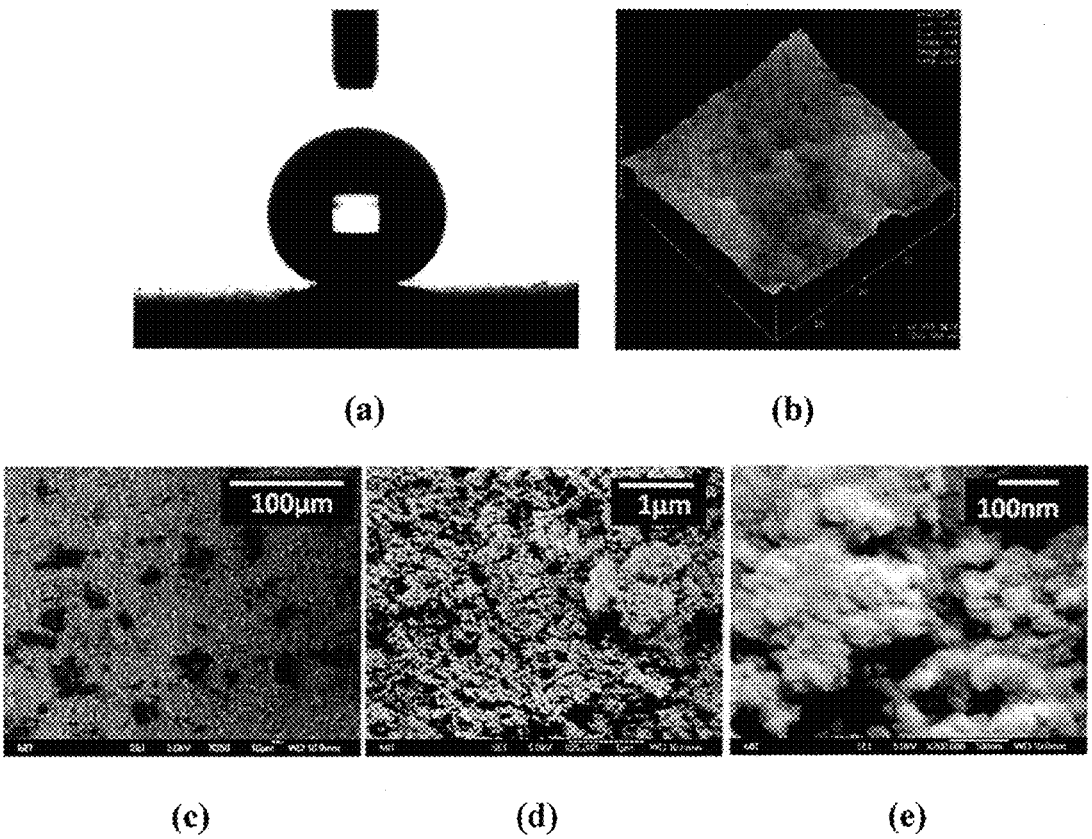
FIGS. 10*a-e* are images illustrating the characteristics of EPD films with suspensions including conductive epoxy. 10*a* is an image of liquid water droplet on EPD modified surface with contact angle of 168°.

FIG. 10*a* shows a representative image of a water droplet on the surface of a substrate modified with EPD and augmented with conductive epoxy. In this case, the average contact angle on the surface is 169° and the average RMS surface roughness obtained via AFM is 640 nm (FIG. 10*b*). In the SEM images of FIG. 10*c-e*, irregular porous structures composed of coagulated $SiO_2$ particles may be observed, providing high surface roughness. In FIG. 10*c*, several ten micron scale features composed of flocculated $SiO_2$ particles may be observed under the SEM. In FIG. 10*d*, micron scale porous structures are visible on the surface, and FIG. 10*e* shows 10 nanometer scale $SiO_2$ particles mechanically connected by the epoxy additive.

Figure 11:
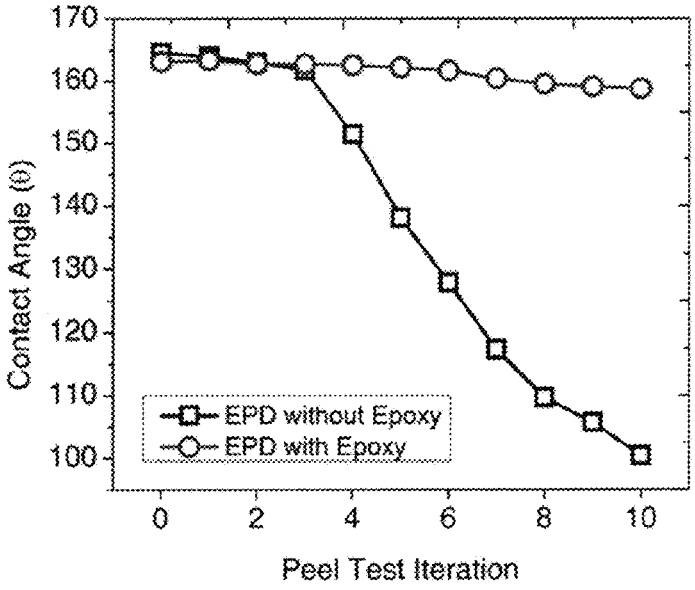
FIG. 11 is a graph illustrating the contact angle on EPD surfaces obtained with epoxy (circles) and without epoxy (squares), after successive peel tests.
Figure 12B:
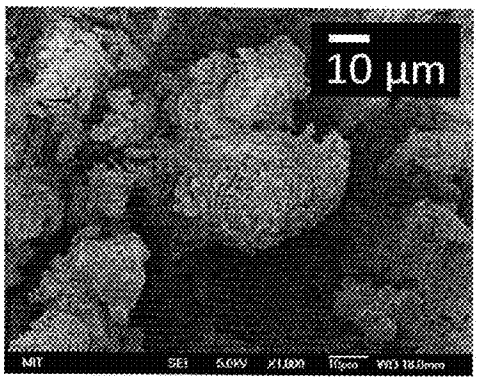
FIGS. 12*a-b* are SEM images of prepared surfaces.
Figure 12B:
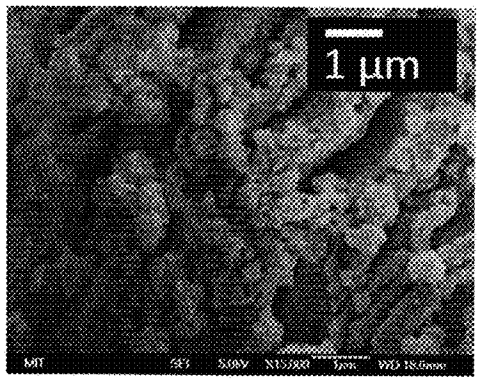
Figure 12A:
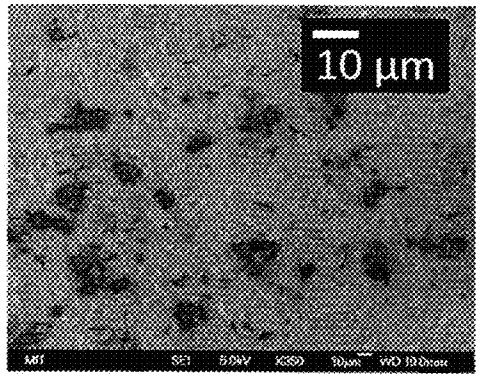
Figure 12A:
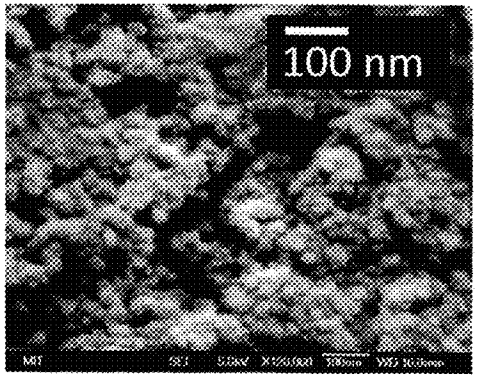

The mechanical stability of two different superhydrophobic surfaces, one deposited with epoxy and one without, may be compared using the peel test. Briefly, in the peel test, the contact angle on a surface is measured before and after an adhesive tape (in this case 1×1 $cm^2$, 1 $N/cm^2$, PTFE adhesive tape, Cole-Parmer) is attached and subsequently removed from the surface. Changes in contact angle on the two surfaces may be measured as a function of the number of peel tests, as shown FIG. 11. While the surface produced without epoxy lost its superhydrophobicity after the fourth peel test, the surface produced with the epoxy maintained its superhydrophobicity after ten iterations. Clearly, the mechanical stability of the deposition layer was dramatically enhanced with the addition of conductive epoxy in that the static contact angle produced without epoxy decreases far faster due to the destruction of the deposition layer after each test. However, the surface obtained with epoxy maintains its hydrophobicity after successive peel tests.

Superhydrophobic surfaces may be produced by EPD. PDMS coated $SiO_2$ particles may be used to acquire low surface energy, high surface roughness, and increase the apparent contact angle. Suspension stability was identified as a key factor to control surface roughness and stability was varied using suspension pH. Two independent techniques may be employed to quantitatively compare suspension stability. For the PDMS coated $SiO_2$ particles, stability ratio generally increases with higher pH, showing steepest increase at around pH 7.5. Four different pH values, 7.4, 7.6, 7.9, and 8.3 may be chosen to compare surface wettability after EPD as a function of suspension stability. The deposited films created at pH 7.6 and a deposition time of 60 s showed the highest average surface roughness (500 nm) and the highest average contact angle (166°). Surface roughness measurements demonstrate that higher surface roughness leads to higher contact angles, as expected. To explain the results, we suggest that coagulated particle size and mobility are the main factors affecting wettability. EPD of small coagulated particles in stable suspensions leads to lower surface roughness and contact angles. On the other hand, low apparent contact angles produced by unstable suspensions are attributed to sedimentation and low particle mobility, prohibiting thick deposition layers. We conclude that unstable suspensions with sufficient mobility to achieve multi-layer coatings are required to produce superhydrophobic surfaces with EPD. In addition, irregular microscale features on the deposited film increase in size as a function of deposition time, ultimately decreasing contact angle. With regards to durability, conductive epoxy was employed to enhance the adhesion between particles and the surface. Deposition layers with suspensions including conductive epoxy exhibit contact angles over 160° with significantly improved mechanical stability. However, further investigation is required to clearly elucidate the function of the conductive epoxy. In summary, we show that by optimizing suspension stability and deposition time, superhydrophobic surfaces can be produced in a one-step EPD process. Ultimately EPD may be an attractive option for manufacturing superhydrophobic surfaces due to its low cost and scalability compared to other fabrication techniques.

The capillary pressure and the spreading speed are well known parameters to characterize porous layers composed of small beads. Both parameters can be obtained by capillary rise experiments (CRE). The capillary pressure and the spreading speed mainly depend on surface energy and particle size and both parameters are not generally proportional to one another. Thus, these parameters are considered separately when evaluating superhydrophilic surfaces. CRE can be used to characterize superhydrophilic surfaces when the surfaces have high capillary pressure and fast spreading speed. If the capillary force exceeds the gravitational force, the wetting line rises. Washburn's equation has been widely used to predict the speed of capillary rise and can be expressed by, $$\frac{dh}{dt} = \frac{R^2}{8\eta h}\left[\frac{2\gamma\cos\theta}{R} - \rho g h\right] \tag{12}$$

where, h is the height of wetting line, t is time, R is the pore radius, η, γ, and ρ are the viscosity, surface tension and density of the liquid, respectively, θ is the native contact angle of surface material, and g is the gravitational acceleration constant. If the gravity effect is negligible (small heights), the relation between the capillary height and time can be expressed by, $$h^2 = \frac{R\gamma\cos\theta}{2\eta}t = v_{cap}t \tag{13}$$

where, $\upsilon_{cap}$ is the spreading speed constant. From CRE, the change in capillary height with respect to time can be obtained and the spreading speed constant can be found by curve fitting.

Capillary pressure can be calculated from the maximum capillary rise height under the assumption of negligible liquid evaporation during the test. Thus, the capillary pressure can be expressed by, $$P_{cap} = \frac{2\gamma\cos\theta}{R} = H_{max}g\rho \tag{14}$$

Where, $H_{max}$ is the maximum capillary rise height. To make superhydrophilic surfaces with EPD, $TiO_2$ nanoparticles (20 nm, anatase, Sigma-Aldrich) were used with acetic acid as solvent. 1 g/L concentration of $TiO_2$ suspensions were prepared for EPD. $TiO_2$ is a representative low surface energy material. Titanium plates (Ultra-Corrosion-Resistant Titanium Grade 2, 0.020" Thick) were used as anode and cathode electrodes. An electric field of 30 V/cm was subjected to the electrodes for 30 seconds to deposit $TiO_2$ particles. Static contact angles were measured on the prepared surfaces. The surfaces produced displayed contact angles near zero degrees. To further evaluate the superhydrophilic surfaces, spreading speed and capillary pressure were measured with CRE.

For CRE, the sample is fixed vertically and the height of water bath is carefully controlled to make contact between the bottom of the sample and the top surface of water. The capillary rise through the substrate is recorded by a digital camera. From CRE, the surface produced showed capillary pressure and spreading speed constant of 58.74 Pa and 0.25 $min^2/s$, respectively. This showed that EPD can effectively be used to produce both superhydrophobic-surfaces and superhydrophilic surfaces by altering surface energy of the deposited particles. Capillary pressure and capillary spreading speed are functions of porosity, which is controlled by suspension stability, deposition time, and particle surface energy. To vary superhydrophilicity, different deposition times and suspension stabilities were employed via EPD. However, the optimal conditions to achieve maximum capillary pressure and spreading speed were variable. By controlling stability and deposition time, we can augment capillary pressure and spreading speed, independently. This method could provide opportunities to investigate wetting phenomena on superhydrophilic surfaces and enhance the performance of surfaces required high wettability.

Other embodiments are within the scope of the following claims.

What is claimed is:

1. A method of altering a property of a surface of a substrate comprising:

suspending a plurality of particles in a solvent;

agglomerating the particles in a suspension, wherein the agglomerated particles consist essentially of particles of a single particle size; and subjecting the suspension of particle agglomerates to electrophoretic deposition onto the substrate for a predetermined time.

2. The method of claim 1, wherein agglomerating the suspension of particles includes adjusting a pH of the suspension of particles to predetermined values.

3. The method of claim 2, wherein adjusting the pH includes adding an acid or a base.

4. The method of claim 1, wherein the solvent is a non-aqueous solvent.

5. The method of claim 4, wherein the non-aqueous solvent is a mixture of an alcohol and water.

6. The method of claim 4, wherein the non-aqueous solvent is acetone and water.

7. The method of claim 1, wherein the solvent is an aqueous solvent.

8. The method of claim 1, wherein subjecting the suspension of particles to electrophoretic deposition onto a substrate includes subjecting the suspension of particles mixed with a bonding additive for electrophoretic co-deposition onto a substrate.

9. The method of claim 8, wherein the bonding additive includes an epoxy or an adhesive.

10. The method of claim 1, wherein the method includes varying a surface energy of the particles by coating the particles with a polymer before suspending the particles in the solvent.

11. The method of claim 10, wherein the polymer is polydimethylsiloxane.

12. The method of claim 1, wherein the particles include alkylsilane-coated particles.

13. The method of claim 1, wherein the particles include ceramic particles, metallic particles, semiconductor particles, carbon nanotubes, carbon black, quantum dots, amorphous materials, nanowires, or polymers.

14. The method of claim 13, wherein the substrate includes titanium, aluminum, stainless steel, gold, silver, brass, bronze, cast iron, copper, nickel, platinum, iron, or tungsten.

15. The method of claim 1, wherein the particles are high surface energy particles, corresponding to a contact angle less than 90 degrees.

16. The method of claim 1, wherein the particles are low surface energy particles, corresponding to a contact angle greater than 90 degrees.

17. The method of claim 1, wherein the agglomerated particles consist essentially of 14 nm polydimethylsiloxane coated $SiO_2$ nanoparticles.

18. A method of altering a property of a surface of a substrate comprising:

suspending a plurality of particles in a solvent;

agglomerating the particles in the suspension;

subjecting the suspension of agglomerated particles to electrophoretic deposition onto the substrate; and drying the substrate with the agglomerated particles deposited thereon after the subjecting step, so as to form a superhydrophilic surface on the substrate.

19. The method of claim 18, wherein the particles are high surface energy particles, corresponding to a contact angle less than 90 degrees.

20. The method of claim 18, wherein the particles comprise titanium dioxide nanoparticles.

21. The method of claim 20, wherein the superhydrophilic surface has a contact angle near zero degrees.

22. The method of claim 18, wherein the particles comprise silicon dioxide nanoparticles.

23. The method of claim 18, wherein the agglomerated particles are nanoparticles.

24. The method of claim 18, wherein the particles have a single particle size.

25. The method of claim 18, wherein agglomerating the suspension of particles includes adjusting a pH of the suspension of particles.

26. A method of altering a property of a surface of a substrate comprising:

(a) suspending a plurality of particles in a solvent, so that a concentration of the particles in the solvent is from 0.1 gram/liter to 1.0 gram/liter;

(b) agglomerating the particles in the suspension; and (c) applying an electric field to subject the agglomerated particles in the suspension to electrophoretic deposition onto the substrate, wherein step (b) is performed before applying the electric field.

27. The method of claim 26, wherein step (c) includes forming a superhydrophobic surface on the substrate.

28. The method of claim 26, wherein step (c) includes forming a surface on the substrate having a water static contact angle of 140 or greater.

29. The method of claim 26, wherein step (c) forms a surface having micrometer scale roughness.

30. The method of claim 26, wherein the particles include polydimethylsiloxane coated $SiO_2$ particles.

31. The method of claim 30, wherein the solvent comprises methanol.

32. The method of claim 26, wherein step (c) is a single electrophoretic deposition step.

33. The method of claim 26, wherein the step of subjecting the suspension of the particle agglomerates to electrophoretic deposition is performed from 30 seconds to 90 seconds.

34. The method of claim 33, wherein the predetermined time affects a resulting morphology of the surface of the substrate.

* * * * *